US010875146B2

(12) United States Patent
Cook et al.

(10) Patent No.: US 10,875,146 B2
(45) Date of Patent: Dec. 29, 2020

(54) DEBRIS-REMOVAL GROOVE FOR CMP POLISHING PAD

(71) Applicant: Rohm and Haas Electronic Materials CMP Holdings, Inc., Newark, DE (US)

(72) Inventors: Lee Melbourne Cook, Atglen, PA (US); Yuhua Tong, Hockessin, DE (US); Joseph So, Wilmington, DE (US); Jeffrey James Hendron, Elkton, MD (US); Patricia Connell, Rising Sun, MD (US)

(73) Assignee: ROHM AND HAAS ELECTRONIC MATERIALS CMP HOLDINGS, Newark, DE (US)

( * ) Notice: Subject to any disclaimer, the term of this patent is extended or adjusted under 35 U.S.C. 154(b) by 81 days.

(21) Appl. No.: 15/079,824

(22) Filed: Mar. 24, 2016

(65) Prior Publication Data

US 2017/0274496 A1 Sep. 28, 2017

(51) Int. Cl.

| | |
|---|---|
| ***B24B 37/26*** | (2012.01) |
| ***B24B 37/16*** | (2012.01) |
| ***B24D 11/00*** | (2006.01) |

(52) U.S. Cl.

CPC ..... *B24B 37/26* (2013.01); *B24B 37/16* (2013.01); *B24D 11/00* (2013.01)

(58) Field of Classification Search

CPC ..... B24B 37/26; B24B 37/16; B24D 11/00
USPC ..... 451/527
See application file for complete search history.

(56) References Cited

U.S. PATENT DOCUMENTS

| | | | | |
|---|---|---|---|---|
| 5,578,362 | A | 11/1996 | Reinhardt et al. | |
| 5,645,469 | A | 7/1997 | Burke et al. | |
| 6,089,966 | A | 7/2000 | Arai et al. | |
| 6,120,366 | A | 9/2000 | Lin et al. | |
| 6,749,714 | B1 * | 6/2004 | Ishikawa | B24B 37/205 156/345.12 |
| 6,843,711 | B1 * | 1/2005 | Muldowney | B24B 37/26 451/527 |
| 7,329,174 | B2 | 2/2008 | Hosaka et al. | |
| 8,734,206 | B2 * | 5/2014 | Chang | B24B 41/06 451/285 |
| 8,968,058 | B2 * | 3/2015 | Kerprich | B24B 37/005 451/527 |
| 2004/0048552 | A1 * | 3/2004 | Kisb.o slashed.ll | B24B 37/26 451/41 |

(Continued)

FOREIGN PATENT DOCUMENTS

| | | |
|---|---|---|
| JP | 4645825 | 3/2011 |
| WO | 2016103862 A1 | 6/2016 |

*Primary Examiner* — Eileen P Morgan
*Assistant Examiner* — Marcel T Dion
(74) *Attorney, Agent, or Firm* — Blake T. Biederman

(57) ABSTRACT

The invention provides a polishing pad suitable for polishing or planarizing at least one of semiconductor, optical and magnetic substrates. The polishing pad includes a polishing layer having a polymeric matrix, a thickness and a polishing track representing a working region of the polishing layer for polishing or planarizing. Radial drainage grooves extend through the polishing track facilitate polishing debris removal through the polishing track and underneath the at least one of semiconductor, optical and magnetic substrates and then beyond the polishing track toward the perimeter of the polishing pad during rotation of the polishing pad.

10 Claims, 14 Drawing Sheets

(56) References Cited

U.S. PATENT DOCUMENTS

| | | | | |
|---|---|---|---|---|
| 2009/0209185 | A1* | 8/2009 | Motonari | B24B 37/26<br>451/527 |
| 2009/0311955 | A1* | 12/2009 | Kerprich | B24B 37/26<br>451/548 |
| 2012/0083187 | A1* | 4/2012 | Okamoto | B24B 37/24<br>451/28 |
| 2013/0012107 | A1* | 1/2013 | Kazuno | B24B 37/22<br>451/41 |
| 2013/0196580 | A1* | 8/2013 | Min | B24B 37/26<br>451/488 |

* cited by examiner

Prior Art

DEBRIS-REMOVAL GROOVE FOR CMP POLISHING PAD

BACKGROUND

The present invention relates to grooves for chemical mechanical polishing pads. More particularly, the present invention relates to groove designs for reducing defects during chemical mechanical polishing.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish work pieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium (e.g., slurry) is dispensed onto the polishing pad and is drawn into the gap between the wafer and polishing layer. The polishing pad and wafer typically rotate relative to one another to polish a substrate. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

Reinhardt et al., U.S. Pat. No. 5,578,362 discloses the use of grooves to provide macrotexture to the pad. In particular, it discloses a variety of patterns, contours, grooves, spirals, radials, dots or other shapes. Specific examples included in Reinhardt are the concentric circular and the concentric circular superimposed with and X-Y groove. Because the concentric circular groove pattern provides no direct flow path to the edge of the pad, the concentric circular groove has proven the most popular groove pattern.

Lin et al., in U.S. Pat. No. 6,120,366, at FIG. 2, disclose a combination of circular plus radial grooves. This example illustrates adding twenty-four radial grooves to a concentric circular groove pattern. The disadvantage of this groove pattern is that it provides limited improvement in polishing with a substantial increase in slurry usage.

Notwithstanding, there is a continuing need for chemical mechanical polishing pads having better combination of polishing performance and slurry usage. Furthermore, there is a need for grooves that reduce defects and increase the useful polishing pad lifetime.

STATEMENT OF INVENTION

An aspect of the invention provides a polishing pad suitable for polishing or planarizing at least one of semiconductor, optical and magnetic substrates with a polishing fluid and relative motion between the polishing pad and the at least one of semiconductor, optical and magnetic substrates, the polishing pad comprising the following: a polishing layer having a polymeric matrix and a thickness, the polishing layer including a center, a perimeter, a radius extending from the center to the perimeter and a polishing track that surrounds the center intersects the radius, the polishing track representing a working region of the polishing layer for polishing or planarizing the at least one of semiconductor, optical and magnetic substrates; a plurality of feeder grooves (δ) intersecting the radius, the feeder grooves (δ) having land areas between the feeder grooves (δ) for polishing or planarizing of the at least one of semiconductor, optical or magnetic substrates with the polishing pad and the polishing fluid, the plurality of feeder grooves (δ) having an average cross-sectional feeder area ($\delta_a$), the average cross-sectional feeder area ($\delta_a$) being total cross-sectional area of each feeder groove divided by total number of feeder grooves (δ); at least one radial drainage groove (ρ) in the polishing layer intersecting with the plurality of feeder grooves (δ) for allowing the polishing fluid to flow from the plurality of feeder grooves (δ) to the at least one radial drainage groove (ρ) and the at least one radial drainage groove (ρ) having an average drainage cross-sectional area ($\rho_a$), the average drainage cross-sectional area of the at least one radial drainage groove ($\rho_a$) being greater than the average cross-sectional feeder ($\delta_a$) area as follows:

$$2*\delta_a \leq \rho_a \leq 8*\delta_a$$

wherein ($n_r$) represents number of radial grooves and ($n_f$) represents the number of feeder grooves and $$(0.15)n_f*\delta_a \leq n_r*\rho_a \leq (0.35)n_f*\delta_a$$

and the at least one radial drainage groove (ρ) extending through the polishing track for facilitating polishing debris removal through the polishing track and underneath the at least one of semiconductor, optical and magnetic substrates and then beyond the polishing track toward the perimeter of the polishing pad during rotation of the polishing pad.

An alternative aspect of the invention provides a polishing pad suitable for polishing or planarizing at least one of semiconductor, optical and magnetic substrates with a polishing fluid and relative motion between the polishing pad and the at least one of semiconductor, optical and magnetic substrates, the polishing pad comprising the following: a polishing layer having a polymeric matrix and a thickness, the polishing layer including a center, a perimeter, a radius extending from the center to the perimeter and a polishing track that surrounds the center intersects the radius, the polishing track representing a working region of the polishing layer for polishing or planarizing the at least one of semiconductor, optical and magnetic substrates; a plurality of feeder grooves (δ) intersecting the radius, the feeder grooves (δ) having land areas between the feeder grooves (δ) for polishing or planarizing of the at least one of semiconductor, optical or magnetic substrates with the polishing pad and the polishing fluid, the plurality of feeder grooves (δ) having an average cross-sectional feeder area ($\delta_a$), the average cross-sectional feeder area ($\delta_a$) being total cross-sectional area of each feeder groove divided by total number of feeder grooves (δ); at least one radial drainage groove (ρ) in the polishing layer intersecting with the plurality of feeder grooves (δ) for allowing the polishing fluid to flow from the plurality of feeder grooves (δ) to the at least one radial drainage groove (ρ) and the at least one radial drainage groove (ρ) having an average drainage cross-sectional area ($\rho_a$), the average drainage cross-sectional area of the at least one radial drainage groove ($\rho_a$) being greater than the average cross-sectional feeder ($\delta_a$) area as follows:

$$2*\delta_a \leq \rho_a \leq 8*\delta_a$$

wherein ($n_r$) represents number of radial grooves and ($n_f$) represents the number of feeder grooves and $$(0.15)n_f*\delta_a \leq n_r*\rho_a \leq (0.35)n_f*\delta_a$$

wherein $n_r$ equals a number between 2 and 12 and the at least one radial drainage groove (ρ) extending through the polishing track for facilitating polishing debris removal through the polishing track and underneath the at least one of semiconductor, optical and magnetic substrates and then beyond the polishing track toward the perimeter of the polishing pad during rotation of the polishing pad.

DETAILED DESCRIPTION

Figure 1:
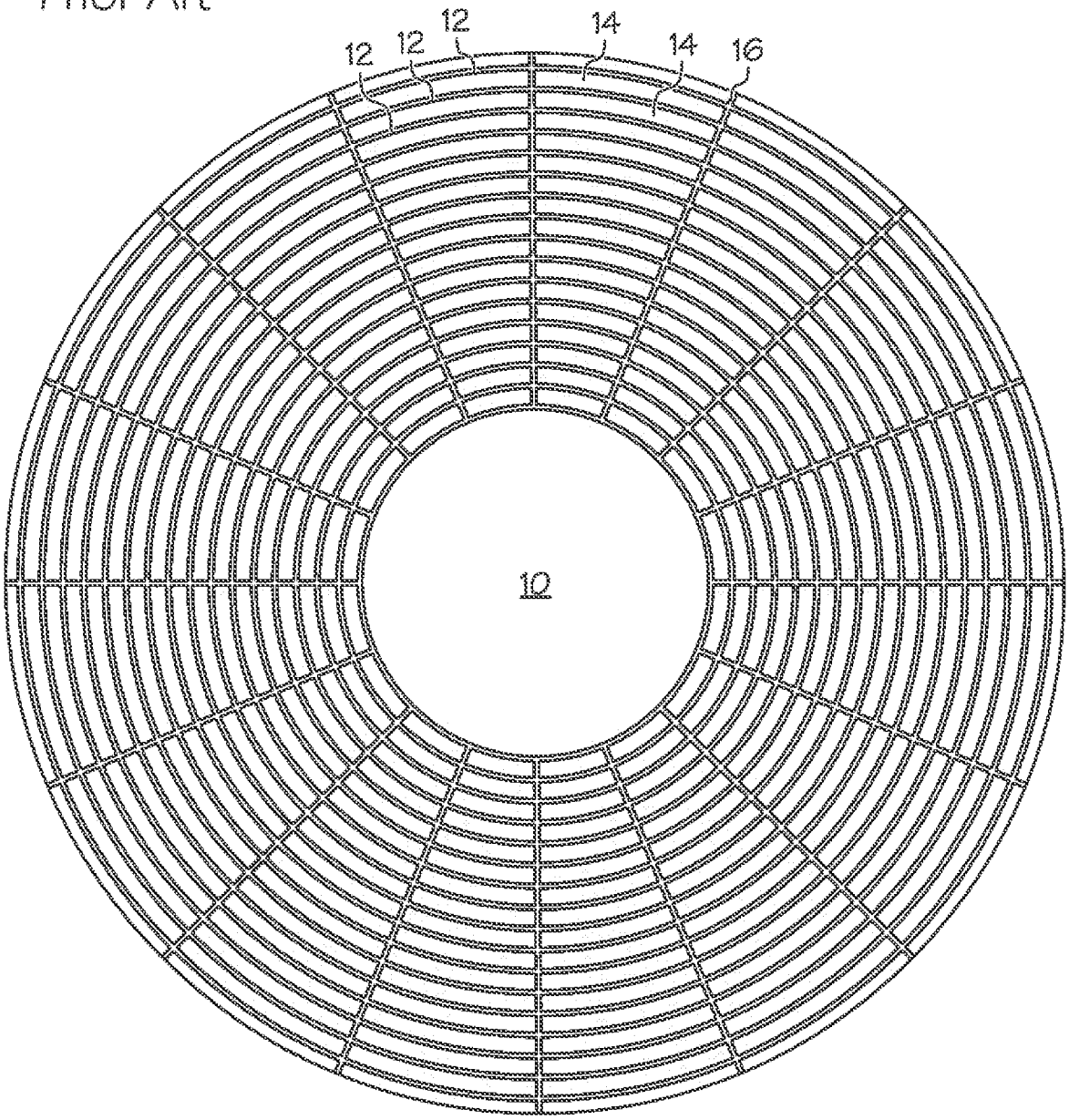
FIG. 1 is a top view schematic of a prior art circular plus radial groove pattern.

The removal process in closed cell pad materials occurs in a thin lubrication film that contains asperities on the pad side. In order for removal to occur, the asperities must come into direct, or semi-direct, contact with the substrate surface. This is affected by tailoring the surface texture to facilitate liquid transport and relief of hydrostatic pressure, and incorporating grooves or other sorts of macrotexture to facilitate drainage. Maintenance of well controlled contact is relatively sensitive to process conditions, maintenance of the texture in the land area between the grooves, and a variety of other variables.

The local environment in the substrate contact zone in current pads has characteristics as follows:

The surface/volume ratio (S/V) is quite high both on the wafer side and the pad side, likely >200:1. This makes liquid transport within the lubrication film quite difficult. More particularly, given the mass removal rates during polishing, the lubrication film is significantly depleted in reactants and significantly enriched in reaction products.

Liquid temperatures are well above ambient, with large depth and lateral gradients. This has been studied internally in significant detail at a macroscopic and microscopic level. The polishing process consumes a great deal of energy, not all of which results in removal. Contact or near-contact friction and viscous friction within the liquid gives rise to significant contact heating. Since the pad is an efficient insulator, the majority of the generated heat is dissipated through the liquid. Thus the local environment within the lubrication film, especially near asperities, is mildly hydrothermal. The temperature gradients, together with the high S/V provide a driving force for precipitation of reaction products within the textural volume, particularly at the pad surface. Since these are likely to be quite large, and are expected to grow in size over time, this may be one of the primary mechanisms for producing microscratch defects. Silica precipitation is a major concern, as the temperature effect on monomer solubility is quite steep.

From the frame of reference of a point on the substrate surface, the thermal and reaction history undergoes extreme cyclic variation. A significant contribution to this cyclic variation is the need for grooves in the pad (to affect uniform contact with the wafer). The liquid environment in the groove is significantly different than in the land area. It is significantly cooler, significantly enriched in reactant, and significantly lower in reaction products. Thus, every point on the wafer sees rapid cycling between these two very different environments. This can provide a driving force for redeposition of polishing byproducts onto the wafer surface, particularly at the trailing edge of contact.

The slurry transport onto the land areas during wafer contact occurs via the grooves. Unfortunately, the grooves serve two purposes; feeding in fresh slurry, and removing spent slurry. In all current pad designs, this must occur simultaneously in the same volume. Thus, the lands are not fed by fresh slurry but by a variable mixture. The location where variable mixing occurs is known as the backmixing zone. While it can be mitigated through groove design, it cannot be eliminated. This constitutes another significant source of large particles for both scratching and residual deposition. The largest concern is that if the slurry in the grooves is not continuously refreshed, formation and growth of large aggregated particles will occur continuously. Given the simultaneous introduction of fresh slurry, and undirected liquid transport, these large particles will eventually be washed onto the land surface in greater and greater numbers, giving rise to a progressive increase in scratch defects. This effect is commonly observed during the use of the pad, regardless of process conditions or mode of conditioning. Defectivity changes during the pad lifetime have three regimes as follows: (a) initial high defectivity when a new pad is introduced (break-in); (b) break-in defectivity decreases to a low steady state for the portion of its use; and (c) end of life state, where both defectivity and wafer non-uniformity rise to undesirably high levels. From the above, it is apparent that preventing or delaying regime (c) improves the useful polishing lifetime of the pad.

The most commonly used feeder groove types are circular. When these circular grooves intersect radial drainage grooves they form arcs. Alternatively, the feeder grooves may be linear segments or sinusoidal waves. Many different feeder groove widths, depths, and pitches are commercially available.

Prior art grooves are generally developed empirically to improve rate uniformity and pad lifetime by controlling the hydrodynamic response. This generally results in relatively thin grooves, especially for circular designs. The most widely employed circular groove is the 1010 groove manufactured to groove specifications as follows: 0.020 in. wide× 0.030 in. deep×0.120 in pitch (0.050 cm wide×0.076 cm deep×0.305 cm pitch). Even connected grooves of these dimensions are not efficient vehicles for transporting liquids due to the low cross-sectional area. An additional issue is the roughness of the exposed pad surfaces. A closed cell porous polymer, such as IC1000, typically has a surface roughness of ~50 microns. For the 1010 groove, which has a surface area/liquid volume ratio of >50:1, the fraction of liquid volume contained in the side-wall texture is quite high (~11%). This leads to stagnation of flow at the side-walls. This is a source of aggregation of waste products, which grow over time into large and damaging point sources of scratches if re-introduced onto the pad surface. Since there is no directional flow out of the grooves, the addition of a means of removing slurry efficiently from the grooves by addition of at least one drainage groove prevents large particle agglomeration or growth, and, therefore, reduce scratches. While it is expected that improved groove drainage would have an immediate beneficial effect, the largest benefit is the increased working lifetime prior to the onset of the end of life effects.

Referring to FIG. 1, polishing pad 10 includes a combination of circular grooves 12 and radial grooves 16. Flat, typically porous land areas 14, divide the circular grooves 12 and radial grooves 16. During polishing, circular grooves 12 combine with radial grooves 16 to distribute polishing slurry or polishing solution to land areas 14 for interaction with a substrate, such as at least one of a semiconductor, optical or magnetic substrate. The circular grooves 12 and radial grooves 16 have a uniform cross section. The problem with these groove patterns is that over time polishing debris collects in the grooves 12 and 16 then periodically moves to land areas 14 where it imparts defects, such as scratch defects of the substrate.

Figure 2:
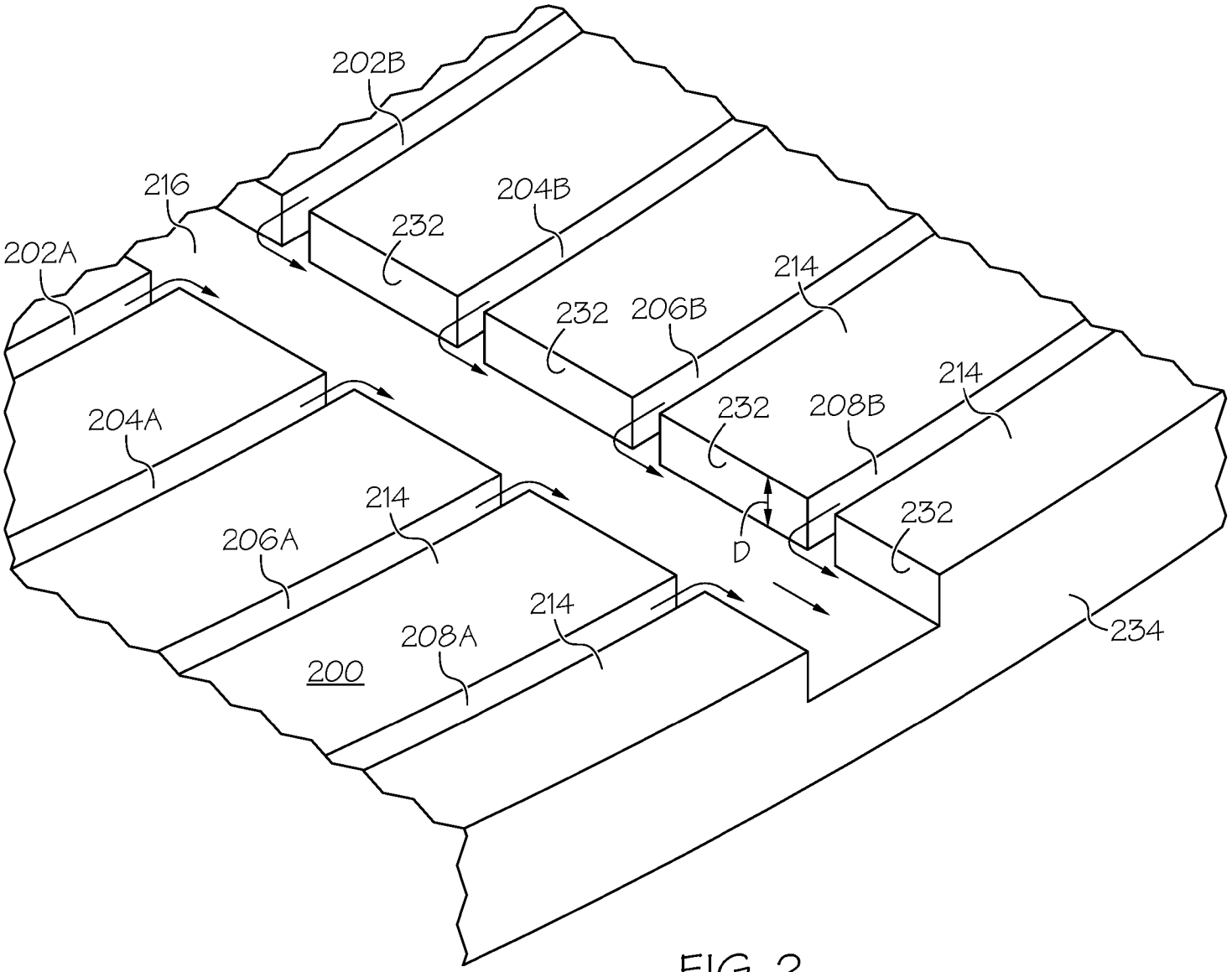
FIG. 2 is a partial broken away schematic top view of the debris removal groove of the invention.

Referring to FIG. 2, polishing pad 200 includes feeder grooves 202A, 204A, 206A, 208A and 202B, 204B, 206B, 208B that can all flow into radial drainage groove 216. In this embodiment, the radial drainage groove 216 has a depth "D" equal to the depth of the feeder grooves. During polishing, feeder grooves 202A, 204A, 206A, 208A and 202B, 204B, 206B, 208B and radial drainage groove 216 distribute polishing slurry or solution over land areas 214. The arrows indicate the flow of the polishing slurry or solution to and past the polishing pad 200's perimeter wall 234. During clockwise polishing, flow from feeder grooves 202A, 204A, 206A and 208A is greater than flow from feeder grooves 202B, 204B, 206B and 208B. During counterclockwise polishing, flow from feeder grooves 202B, 204B, 206B and 208B is greater than flow from feeder grooves 202A, 204A, 206A and 208A. This optional embodiment allows all polishing debris an unencumbered exit from the polishing pad 200 through radial drainage groove 216.

Figure 2A:
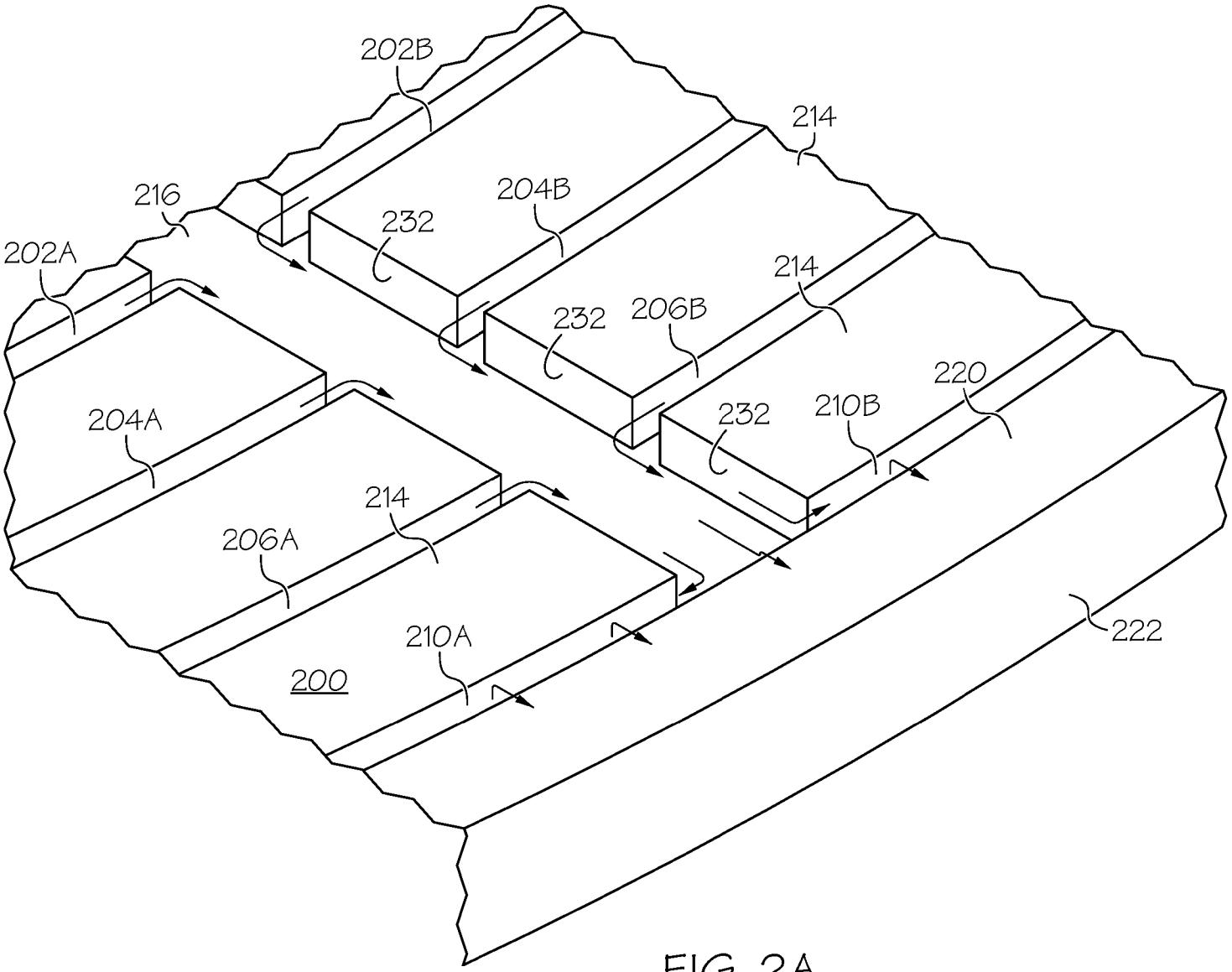
FIG. 2A is a partial broken away schematic top view of the debris removal groove of the invention that includes a perimeter land area.

Referring to FIG. 2A, polishing pad 200 includes feeder grooves 202A, 204A, 206A and 202B, 204B, 206B that can all flow into radial drainage groove 216. In this embodiment, the radial drainage groove 216 has a depth "D" equal to the depth of the feeder grooves or the height of side walls 232. During polishing, feeder grooves 202A, 204A, 206A and 202B, 204B, 206B and radial drainage groove 216 distribute polishing slurry or solution over land areas 214. From drainage groove 216 the polishing slurry or solution flows through perimeter grooves 210A and 210B. The polishing slurry or solution then exits perimeter grooves 210A and 210B over perimeter land area 220 and past perimeter wall 222. The arrows indicate the flow of the polishing slurry or solution to the perimeter grooves 210A and 210B, over perimeter land area 220 and past the polishing pad 200's perimeter wall 222. During clockwise polishing, flow from feeder grooves 202A, 204A and 206A is greater than flow from feeder grooves 202B, 204B and 206B. During counterclockwise polishing, flow from feeder grooves 202B, 204B and 206B is greater than flow from feeder grooves 202A, 204A and 206A. This optional embodiment slows the exit of polishing slurry or solution and can increase polishing efficiency for some polishing combinations.

Figure 3:
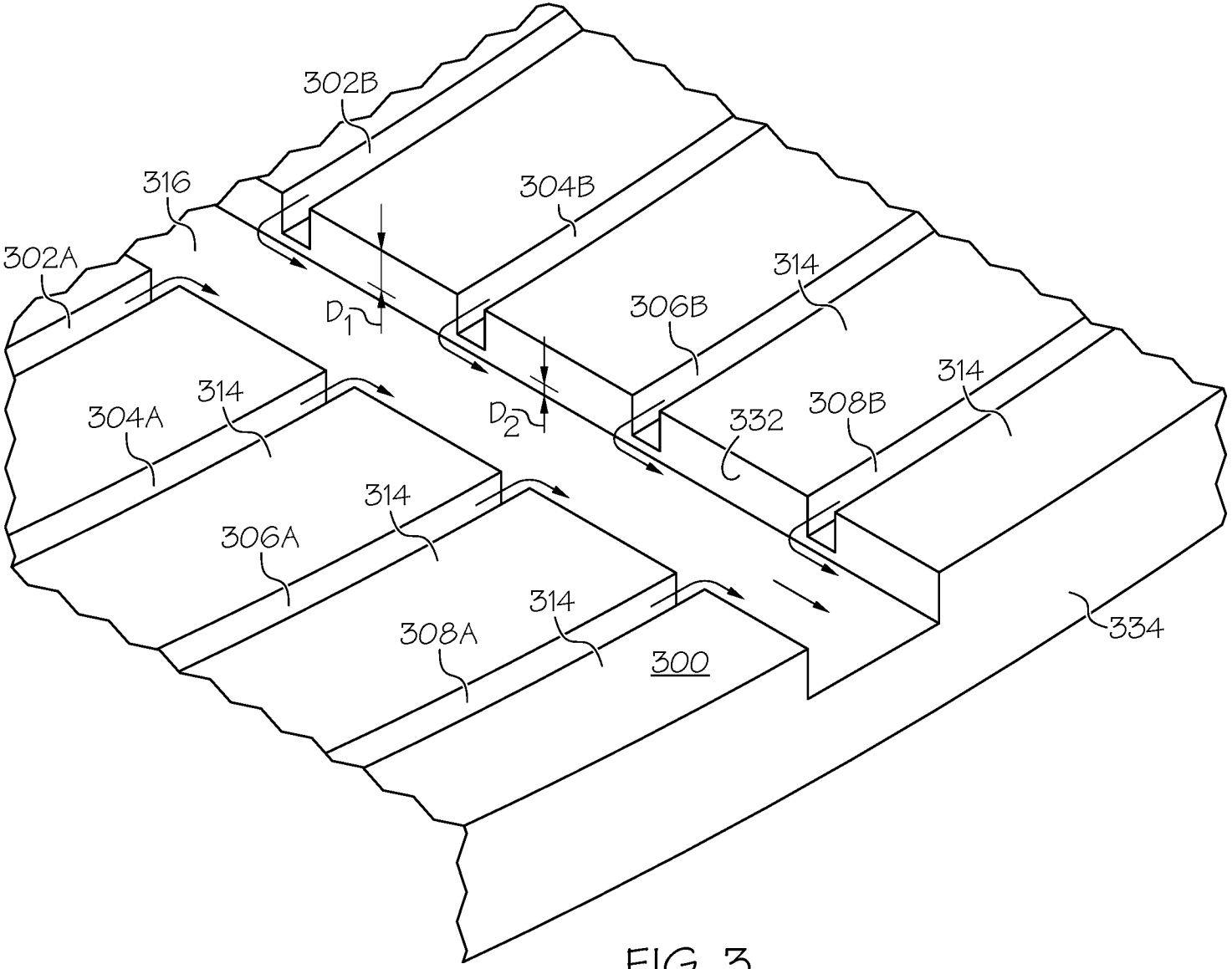
FIG. 3 is a partial broken away schematic top view of the debris removal groove of the invention illustrating the flow through feeder and debris removal grooves.

Referring to FIG. 3, polishing pad 300 includes feeder grooves 302A, 304A, 306A, 308A and 302B, 304B, 306B, 308B that can all flow into radial drainage groove 316. In this embodiment, the radial drainage groove 316 has a depth "D" greater than the depth $D_1$ of the feeder grooves 302A, 304A, 306A, 308A and 302B, 304B, 306B, 308B. In particular, drainage groove 316 extends additional depth $D_2$ below the depth $D_1$ of the feeder grooves 302A, 304A, 306A, 308A and 302B, 304B, 306B, 308B. The height of side walls 332 is equal to depth $D_1$ plus depth $D_2$. During polishing, feeder grooves 302A, 304A, 306A, 308A and 302B, 304B, 306B, 308B and radial drainage groove 316 distribute polishing slurry or solution over land areas 314. The arrows indicate the flow of the polishing slurry or solution to and past the polishing pad 300's perimeter wall 334. During clockwise polishing, flow from feeder grooves 302A, 304A, 306A and 308A is greater than flow from feeder grooves 302B, 304B, 306B and 308B. During counterclockwise polishing, flow from feeder grooves 302B, 304B, 306B and 308B is greater than flow from feeder grooves 302A, 304A, 306A and 308A. This optional embodiment allows all polishing debris an unencumbered exit from the polishing pad 300 through radial drainage groove 316.

Figure 3A:
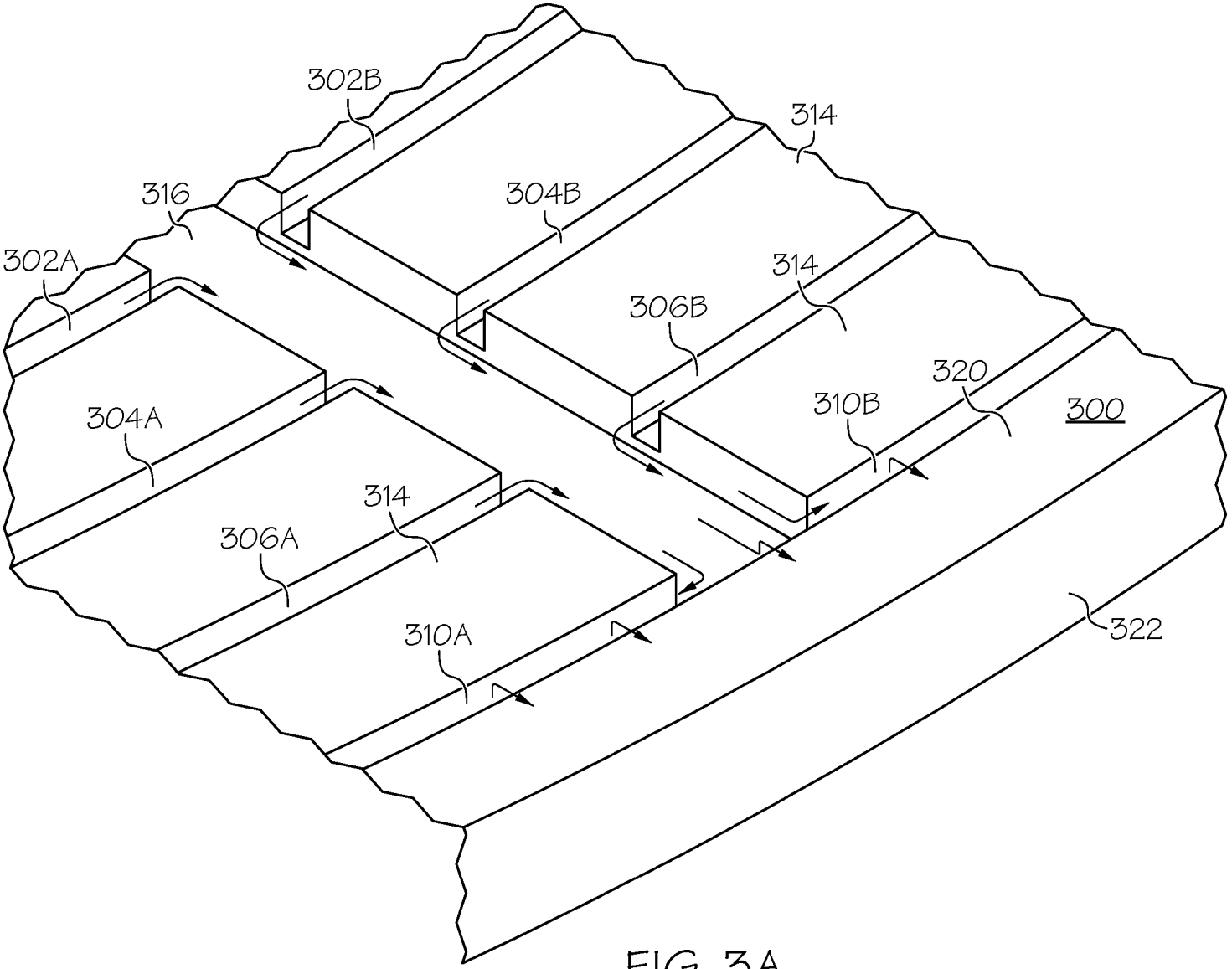
FIG. 3A is a partial broken away schematic top view of the debris removal groove of the invention illustrating the flow through feeder and debris removal grooves that includes a perimeter land area.

Referring to FIG. 3A, polishing pad 300 includes feeder grooves 302A, 304A, 306A and 302B, 304B, 306B that can all flow into radial drainage groove 316. In this embodiment, the radial drainage groove 316 has a depth "D" greater than the depth $D_1$ of the feeder grooves 302A, 304A, 306A, 308A and 302B, 304B, 306B, 308B. In particular, drainage groove 316 extends additional depth $D_2$ below the depth $D_1$ of the feeder grooves 302A, 304A, 306A, 308A and 302B, 304B, 306B, 308B. This design facilitates the flow of high density polishing debris over perimeter land 320 area to the polishing pad 300's perimeter wall 322. During polishing, feeder grooves 302A, 304A, 306A and 302B, 304B, 306B and radial drainage groove 316 distribute polishing slurry or solution over land areas 314. From drainage groove 316 the polishing slurry or solution flows through perimeter grooves 310A and 310B. The polishing slurry or solution then exits perimeter grooves 310A and 310B over perimeter land area 320 and past perimeter wall 322. The arrows indicate the flow of the polishing slurry or solution to the perimeter grooves 310A and 310B, over perimeter land area 320 and past the polishing pad 300's perimeter wall 322. During clockwise polishing, flow from feeder grooves 302A, 304A and 306A is greater than flow from feeder grooves 302B, 304B and 306B. During counterclockwise polishing, flow from feeder grooves 302B, 304B and 306B is greater than flow from feeder grooves 302A, 304A, and 306A. This optional embodiment slows the exit of polishing slurry or solution and can increase polishing efficiency for some polishing combinations.

Figure 4:
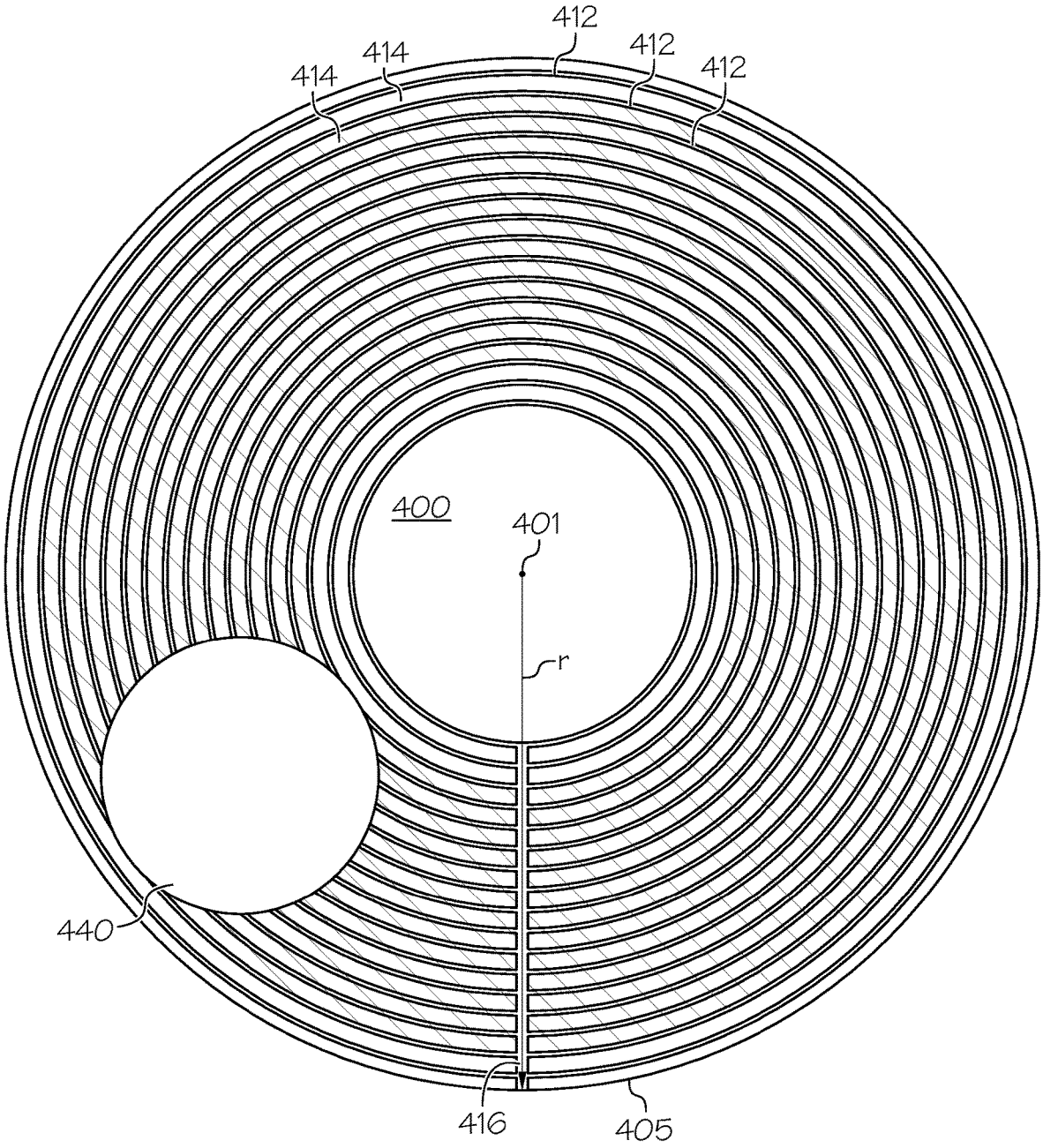
FIG. 4 is a top view schematic of a debris groove pattern of the invention having one debris removal channel and a wafer substrate.

Referring to FIG. 4, polishing pad 400 has center 401 and perimeter 405 where radius r extends from center 401 to perimeter 405. In this embodiment, wafer 440 moves with respect to the polishing pad 400 around the wafer track marked with parallel lines and over a single radial drainage groove 416. FIG. 4 shows the wafer covering multiple feeder grooves 412 and land areas 414. The radial drainage groove 416 drains all the feeder grooves in the wafer track and outside the wafer track.

Figure 5:
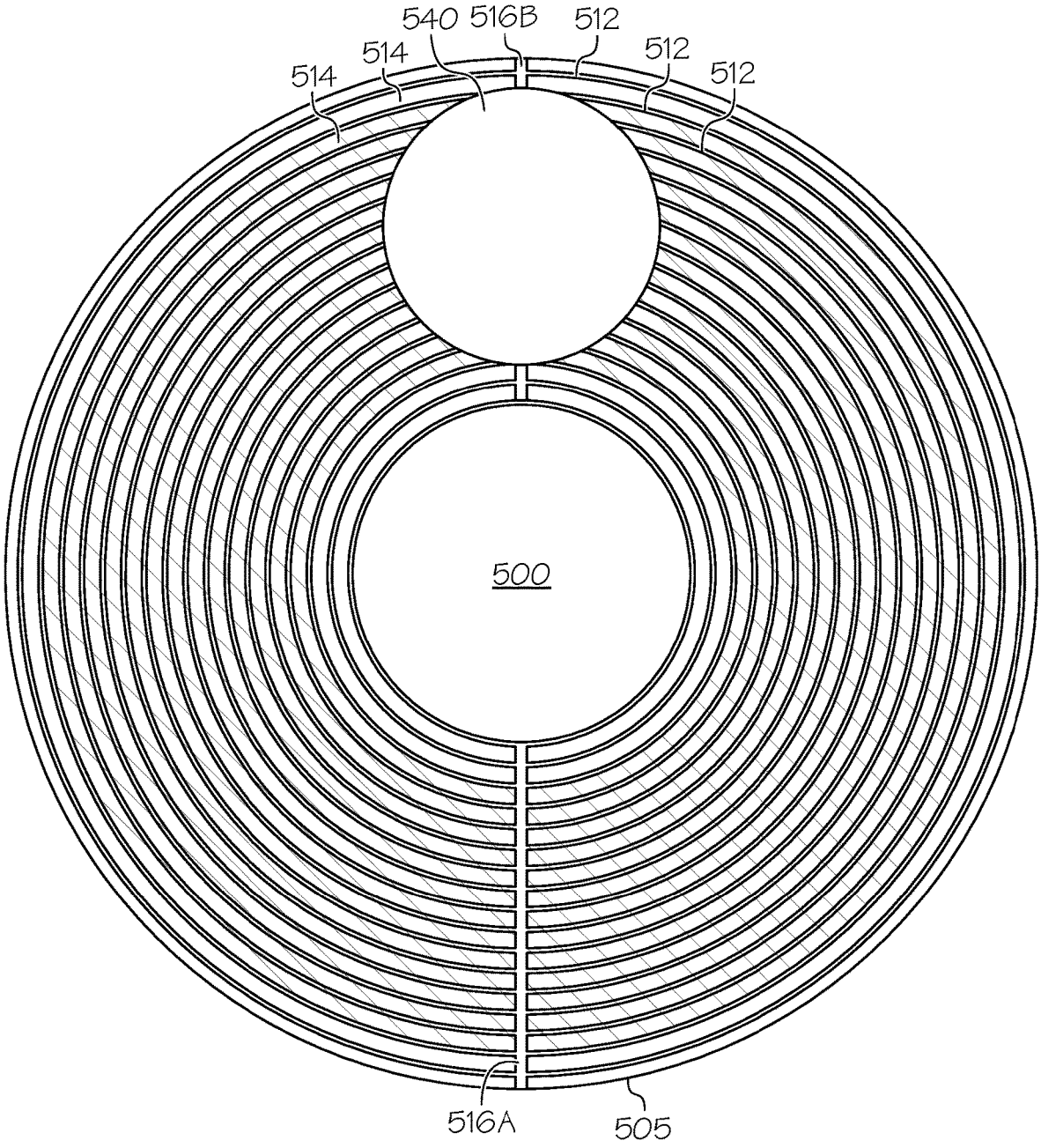
FIG. 5 is a top view schematic of a debris groove pattern of the invention having two debris removal channels and a wafer substrate.

Referring to FIG. 5, polishing pad 500 illustrates wafer 540 that moves with respect to the polishing pad 500 around the wafer track marked with parallel lines and over a two radial drainage grooves 516A and 516B spaced 180° apart. FIG. 5 shows the wafer covering multiple feeder grooves 512 and land areas 514. In particular, the radial drainage grooves 516 extend through the polishing track for facilitating polishing debris removal through the polishing track and underneath the wafer and then beyond the polishing track toward the perimeter 505 of the polishing pad 500 during rotation of the polishing pad 500. The radial drainage grooves 516A and 516B drain all the feeder grooves in the wafer track and outside the wafer track.

Figure 6:
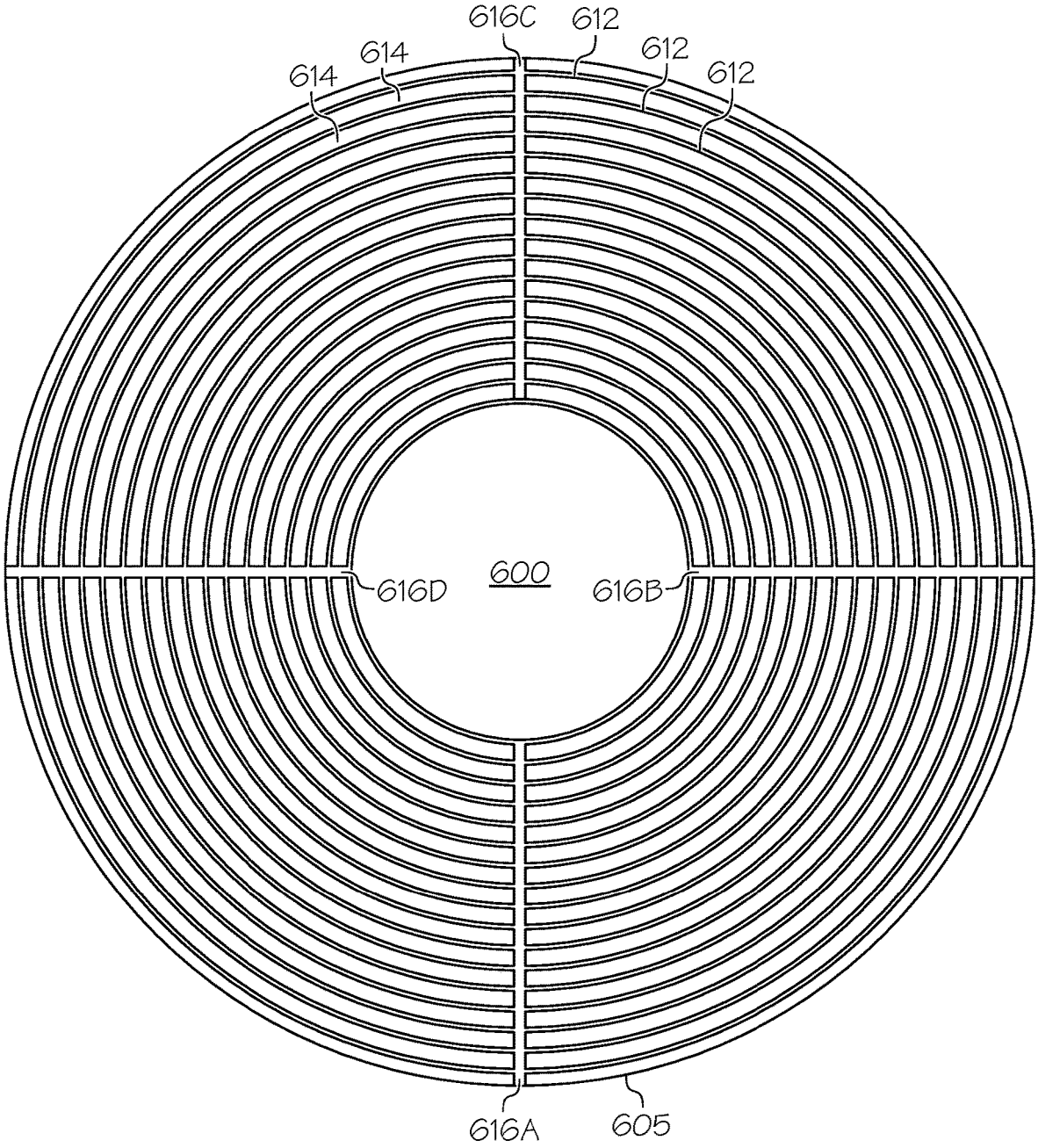
FIG. 6 is a top view schematic of a debris groove pattern of the invention having four debris removal channels.

Referring to FIG. 6, polishing pad 600 illustrates four radial drainage grooves 616A to 616D spaced 90° apart. Alternatively, the spacing of the radial drainage and feeder grooves could be uneven. During operation, polishing slurry or solution flows outward toward perimeter 605 over the land areas 614 and through the radial drainage grooves 616A to 616D. The radial drainage groove 616A to 616D drain all the feeder grooves 612 in the wafer track (not seen) and outside the wafer track.

Figure 6A:
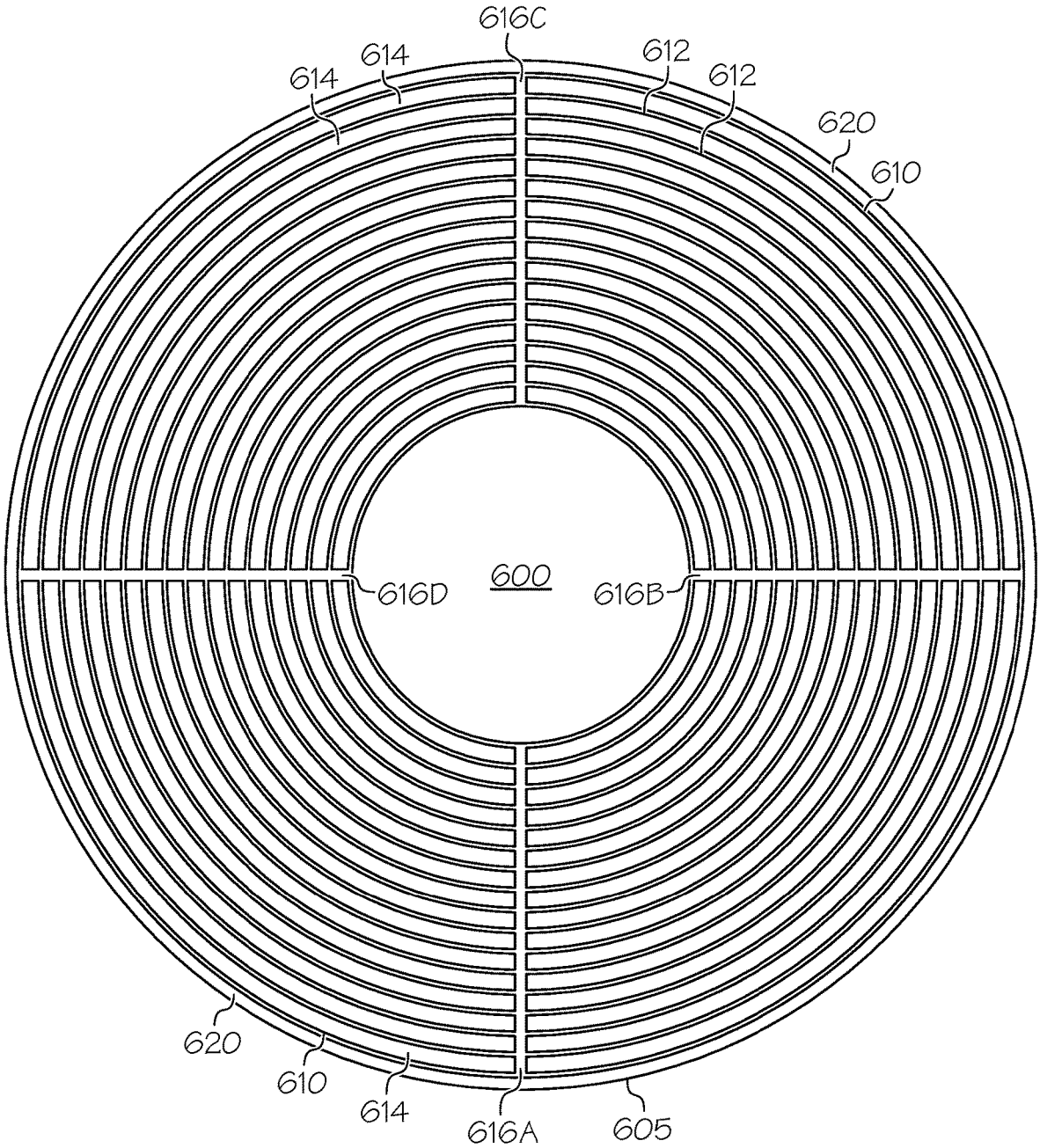
FIG. 6A is a top view schematic of a debris groove pattern of the invention having four debris removal channels that includes a perimeter land area.

Referring to FIG. 6A, polishing pad 600 illustrates four radial drainage grooves 616A to 616D spaced 90° apart. Alternatively, the spacing of the radial drainage and feeder grooves could be uneven. During operation, polishing slurry or solution flows outward toward perimeter 605 over the land areas 614 and through the radial drainage grooves 616A to 616D. Before reaching the perimeter 605, the polishing slurry or solution flows into perimeter groove 610 and from perimeter groove 610 over perimeter land area 620. The radial drainage groove 616A to 616D drain all the feeder grooves 612 in the wafer track (not seen) and outside the wafer track.

Figure 7:
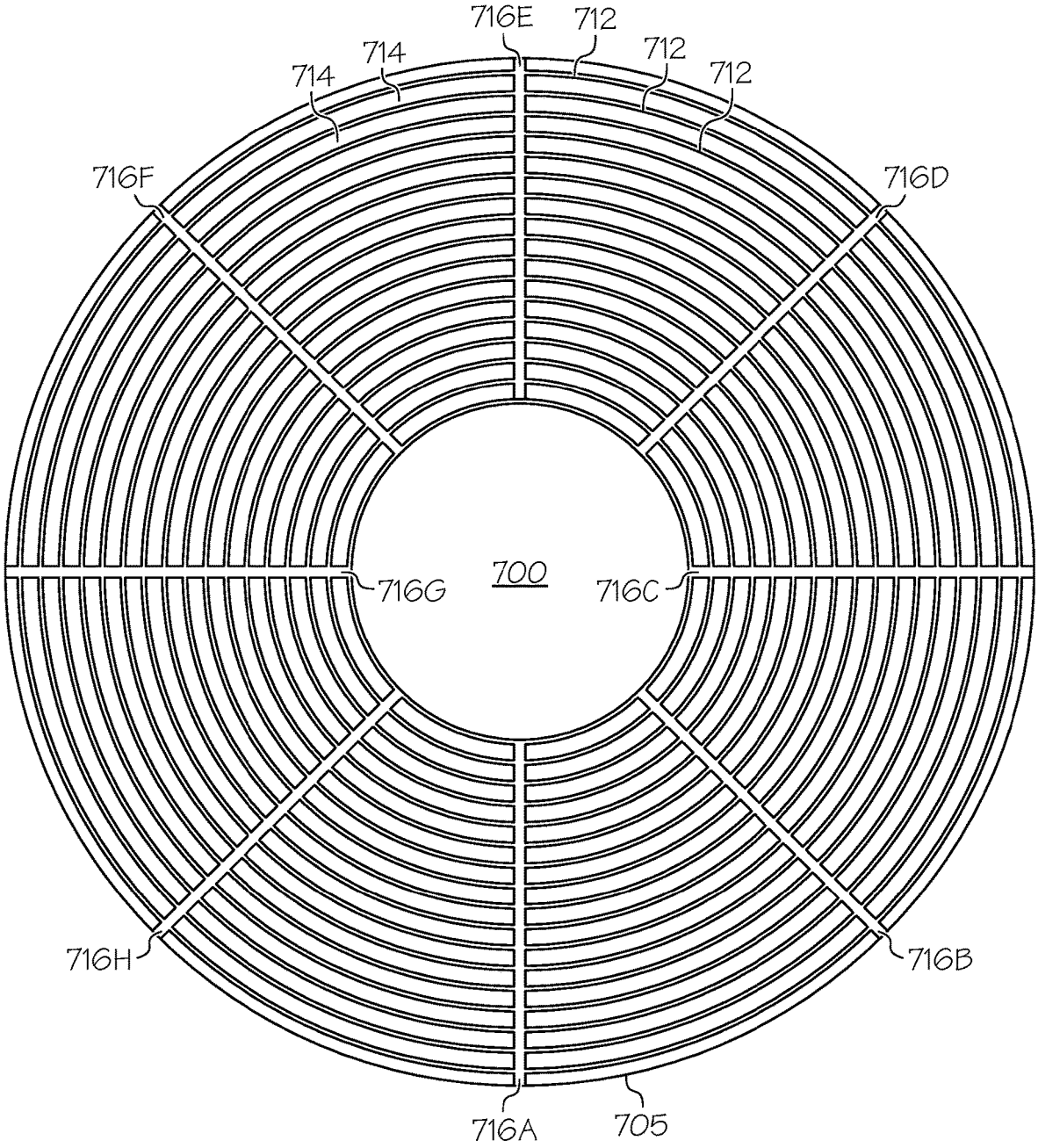
FIG. 7 is a top view schematic of a debris groove pattern of the invention having eight debris removal channels.

Referring to FIG. 7, polishing pad 700 illustrates eight radial drainage grooves 716A to 716H spaced 45° apart. Alternatively, the spacing of the radial drainage and feeder grooves could be uneven. During operation, polishing slurry or solution flows outward toward perimeter 705 over the land areas 714 and through the radial drainage grooves 716A to 716H. The radial drainage grooves 716A to 716H drain all the feeder grooves 712 in the wafer track (not seen) and outside the wafer track.

Figure 8:
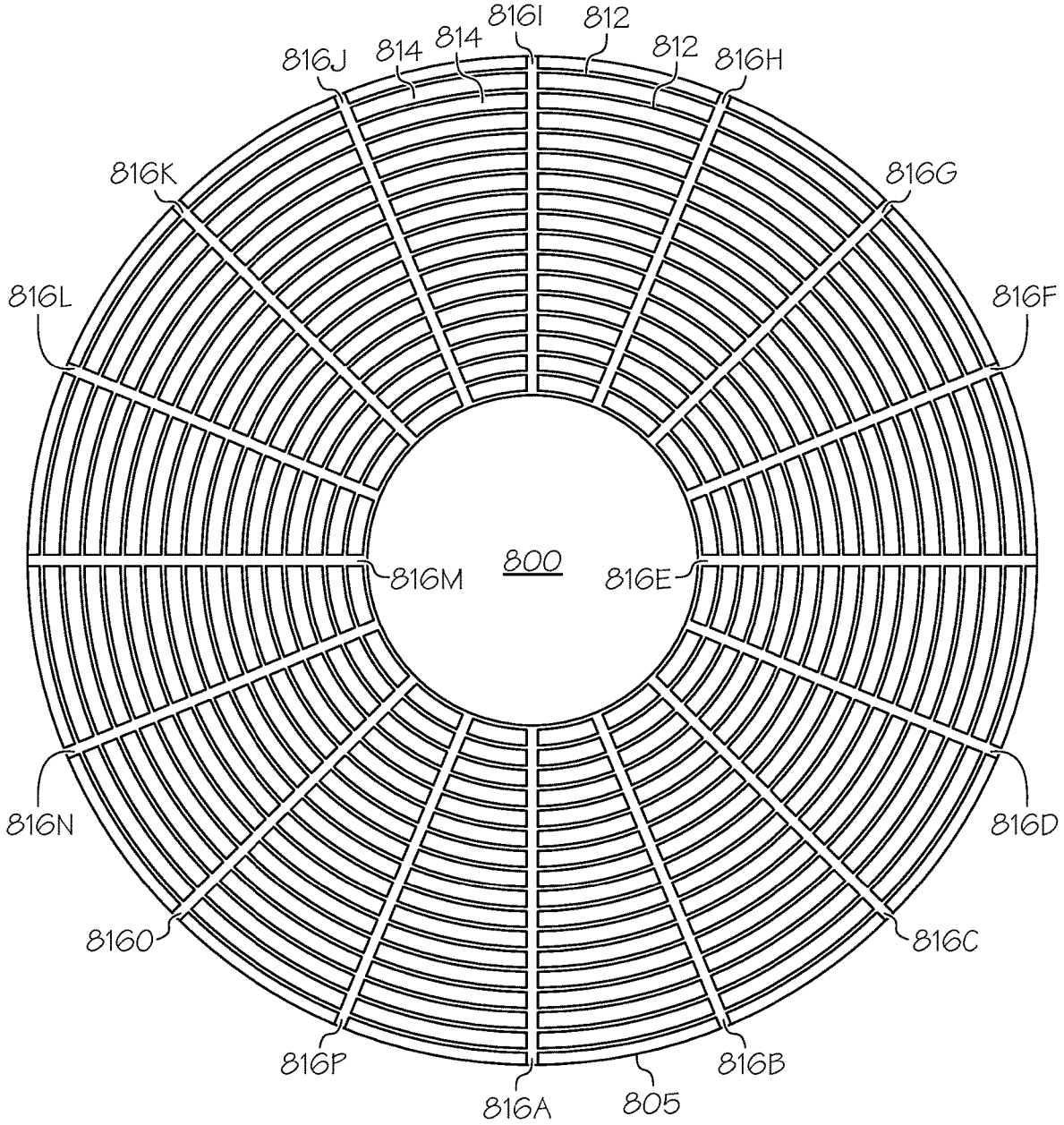
FIG. 8 is a top view schematic of a debris groove pattern of the invention having sixteen debris removal channels.

Referring to FIG. 8, polishing pad 800 illustrates sixteen radial drainage grooves 916A to 916P spaced 22.5° apart. Alternatively, the spacing of the radial drainage and feeder grooves could be uneven. During operation, polishing slurry or solution flows outward toward perimeter 805 over the land areas 814 and through the radial drainage grooves 816A to 816P. The radial drainage groove 816A to 816P drain all the feeder grooves 812 in the wafer track (not seen) and outside the wafer track.

Figure 9:
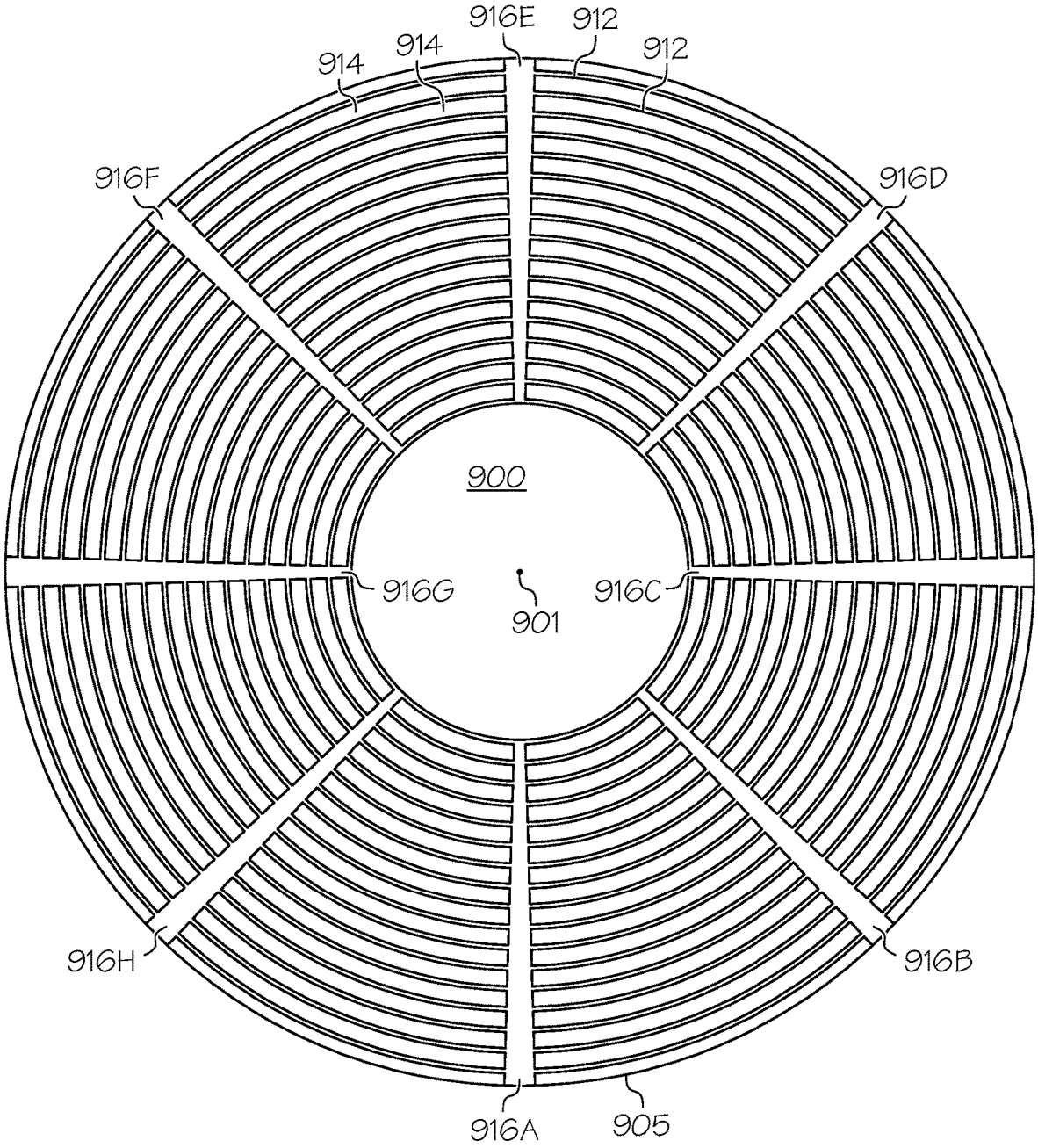
FIG. 9 is a top view schematic of a debris groove pattern of the invention having eight tapered debris removal channels.

Referring to FIG. 9, polishing pad 900 illustrates eight tapered radial drainage grooves 916A to 916H spaced 45° apart. Alternatively, the spacing of the radial drainage and feeder grooves could be uneven. During operation, polishing slurry or solution flows outward toward perimeter 905 over the land areas 914 and through the tapered radial drainage grooves 916A to 916H. The tapered radial drainage grooves 916A to 916H all have a width greater toward the perimeter 905 than the center 901. This taper allows the radial drainage groove to accommodate increased fluid and polishing debris loads. Alternatively to width, depth could increase toward the perimeter to increase flow. But for most circumstances, increased centrifical forces are sufficient to accommodate increased flow through the drainage groove as the polishing slurry or solution flows toward the pad's perimeter.

For the invention, the feeder grooves ($\delta$) have an average cross-sectional feeder area ($\delta_a$) where the average cross-sectional feeder area ($\delta_a$) is the total cross-sectional area of each feeder groove divided by the total number of feeder grooves ($\delta$). The radial drainage groove ($\rho$) has an average drainage cross-sectional area ($\rho_a$) where the average drainage cross-sectional area of the radial drainage groove ($\rho_a$) is at least two times greater than the average cross-sectional feeder ($\delta_a$) area but less than eight times greater than cross-sectional feeder ($\delta_a$) as follows:

$$2*\delta_a \leq \rho_a \leq 8*\delta_a$$

wherein ($n_r$) represents number of radial grooves and ($n_f$) represents the number of feeder grooves representing a total summation from each side of the radial drainage groove as follows:

$$(0.15)n_f*\delta_a \leq n_r*\rho_a \leq (0.35)n_f*\delta_a$$

Typically, $n_r$ is 1 to 16. Most advantageously, $n_r$ is 2 to 12.

EXAMPLE 1

A series of polishing pads with increasing numbers of radial grooves (1, 2, 4, 8 and 16) created increased drainage capacity with a constant feed groove area. The polishing pads had groove dimensions as follows:

Cross-sectional area of a single circular feeder groove: 0.0039 $cm^2$

Number of feeder grooves bisected by a drainage groove: 80

Total cross-sectional area of feeder grooves feeding into a single drainage groove: =0.0039*80*2=0.624 $cm^2$.

Note: Feeder groove calculations used in this specification assume slurry flowing from both sides of each single intersection between a feeder groove and a drainage groove. For example, 80 circular feeder grooves form 160 groove intersections with a single drainage groove. Cross-sectional area of a single drainage groove: 0.01741932 $cm^2$.

Radial drainage groove to feeder groove cross sectional area ratio if a single drainage groove were applied: 0.03.

Figure 10:
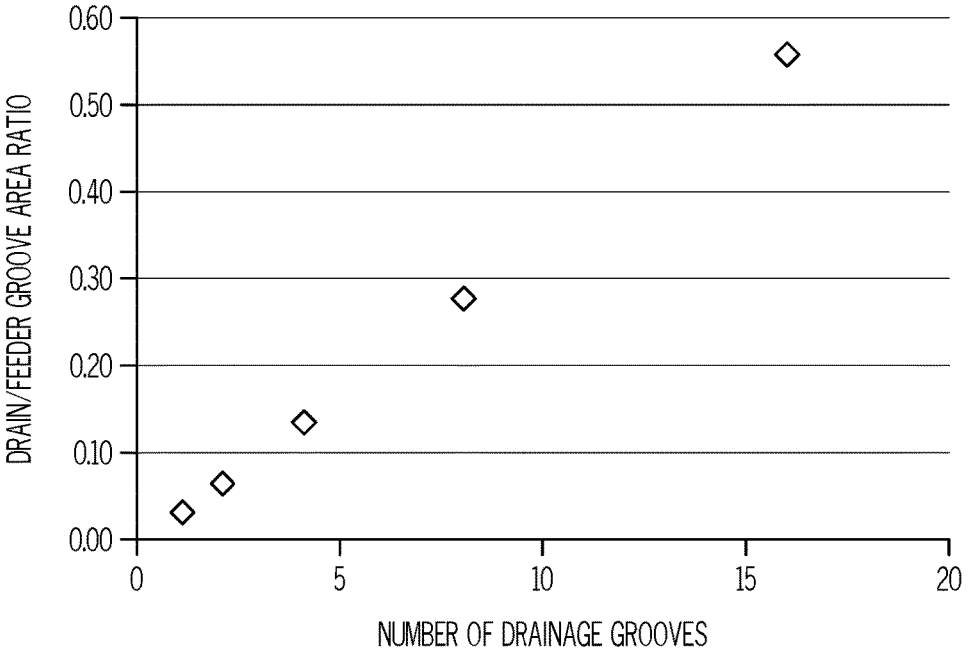
FIG. 10 is plot of radial drainage groove ratio as a function of the number of drainage grooves deployed.

In the example shown, a single drainage groove was insufficient to effectively drain the set of feeder grooves. However, by addition of multiple feeder grooves, drainage efficiency can readily be increased to acceptable levels. FIG. 10 graphically illustrates the improved drainage capacity increases with the number of grooves.

A relative drainage area ratio of less than 0.15 is not efficacious. Because of the delivery of excess fresh slurry over the upper surface of the pad the number of radial grooves depends upon a number of variables, including the slurry delivery rate. If the drainage capacity is too high, then this results in insufficient slurry in the grooves available for use, and may result in pad drying. This is a detrimental source of defects, such as scratching defects. The drainage grooves of the invention reduce defects. Similarly, too low a drainage ratio will not remove sufficient polishing byproducts and not reduce defects. Too high a drainage ratio affects hydrodynamics (manifested by increased wafer non-uniformity) and increased defects over even the case where no drainage grooves are employed.

EXAMPLE 2

In order to assess the optimal range, the following experiment was performed. Five different radial grooves were applied to a set of closed cell polyurethane polishing pads. These pads had circular grooves of 20 mil wide, 30 mil deep and 120 mil pitch (0.051 cm×0.076 cm×0.305 cm pitch). Designations and radial groove dimensions and number are shown in Table 1.

TABLE 1

Pad Sample Set

| | Radial Groove width | | Radial Groove Depth | | Radial Groove |
|---|---|---|---|---|---|
| Pad | (mil) | (mm) | (mil) | (mm) | Number |
| A | 0 | 0 | 0 | 0 | 0 |
| 1 | 60 | 1.52 | 30 | 0.76 | 8 |
| 2 | 120 | 3.05 | 30 | 0.76 | 8 |
| 3 | 180 | 4.57 | 30 | 0.76 | 8 |
| 4 | 90 | 2.29 | 30 | 0.76 | 8 |
| 5 | 90 | 2.29 | 30 | 0.76 | 16 |

TABLE 2

Drainage Groove to Feeder Groove Area Ratio

| Pad | No. Drainage Grooves | Drainage/Feeder Area Ratio |
|---|---|---|
| A | 0 | Undefined |
| 1 | 8 | 0.15 |
| 2 | 8 | 0.30 |
| 3 | 8 | 0.45 |
| 4 | 8 | 0.225 |
| 5 | 16 | 0.45 |

Polishing conditions are summarized as follows:

MDC Mirra, K1501-50 μm colloidal slurry

Saesol AK45(8031c1) diamond disk, pad break-in 30 min 7 psi (48 kPa), full insitu condition at 7 psi (48 kPa), Process: Pad Downforce 3 psi (20.7 kPa)

Platen Speed 93 rpm

Carrier Speed 87 rpm

Slurry Flow 200 ml/m

Monitor wafer polished at wafer counts of 11, 37, 63, 89, 115, 141, 167 and 193.

Defect count was with a Surfscan SP1analyzer from KLA-Tencor.

Figure 11:
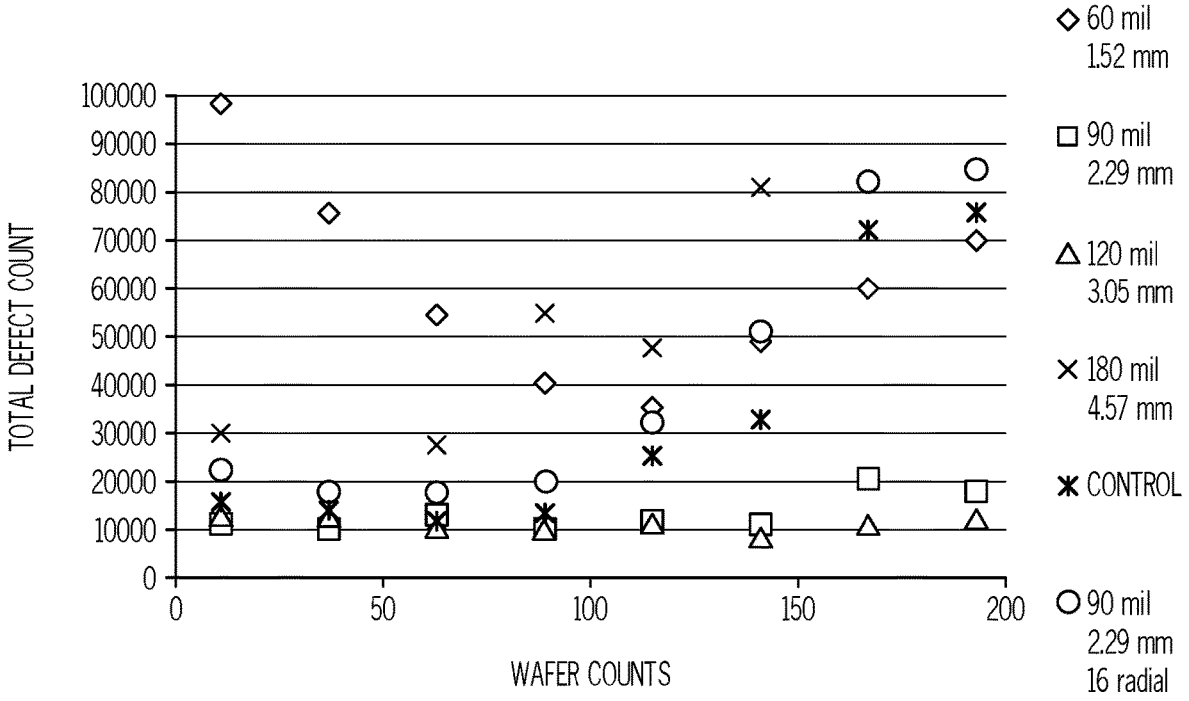
FIG. 11 is a plot of total defects versus time that includes polishing pad groove patterns of the invention.
Figure 12:
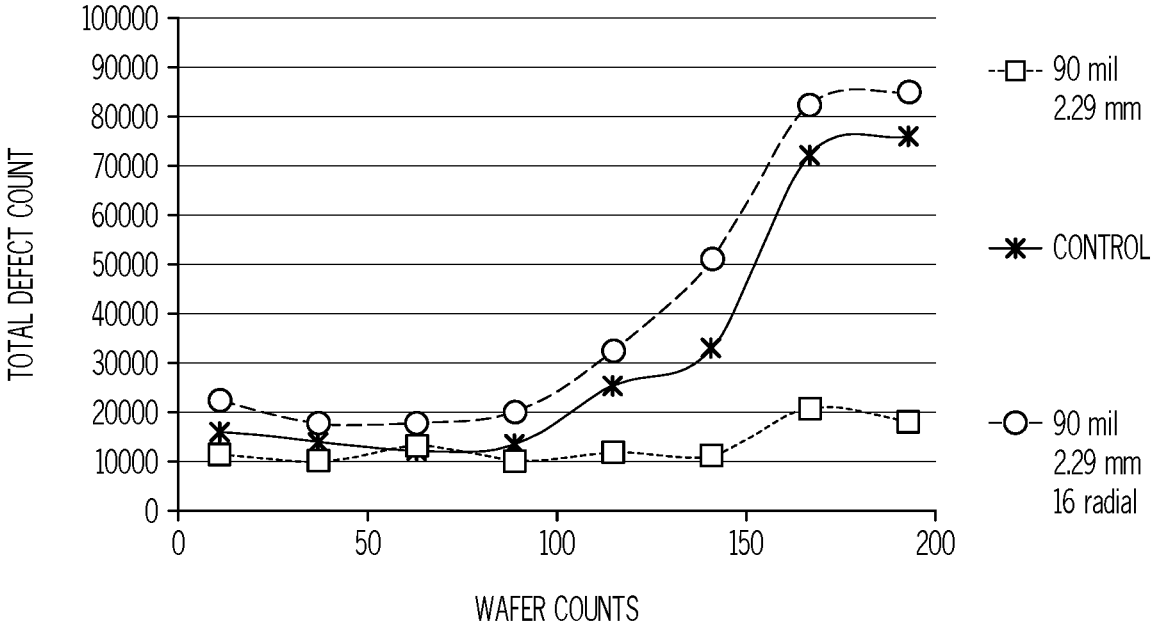
FIG. 12 is a plot of total defects versus time for control pad versus 90 mil (0.23 cm) radial overlay samples of the invention.

Each pad was broken-in to remove start-up effects, and polished for 200 wafers to assess rate and defectivity stability. There were no large differences in rate between pads. However, there were significant differences in defectivity, as shown in FIGS. 11 and 12. The pad samples with 90 mil (0.229 cm) width/8 radial grooves, and 120 mil (0.305 cm) width/8 radial grooves showed low and stable defect levels. All others, including the control showed higher defect levels that varied over the duration of the test, and increased with increasing polish time. This is particularly evident in FIG. 11, which compares the control pad behavior to the 90 mil (0.229 cm) groove pads.

The doubling of the number of drainage grooves (drainage to feeder area ratio increased from 0.225 to 0.45) significantly increased defectivity overall, even relative to the control. This is taken as an indication that there is a critical range for the drainage efficiency ratio. This critical range can vary with the size and number of feeder groove and the size of the radial drainage groove.

Figure 13:
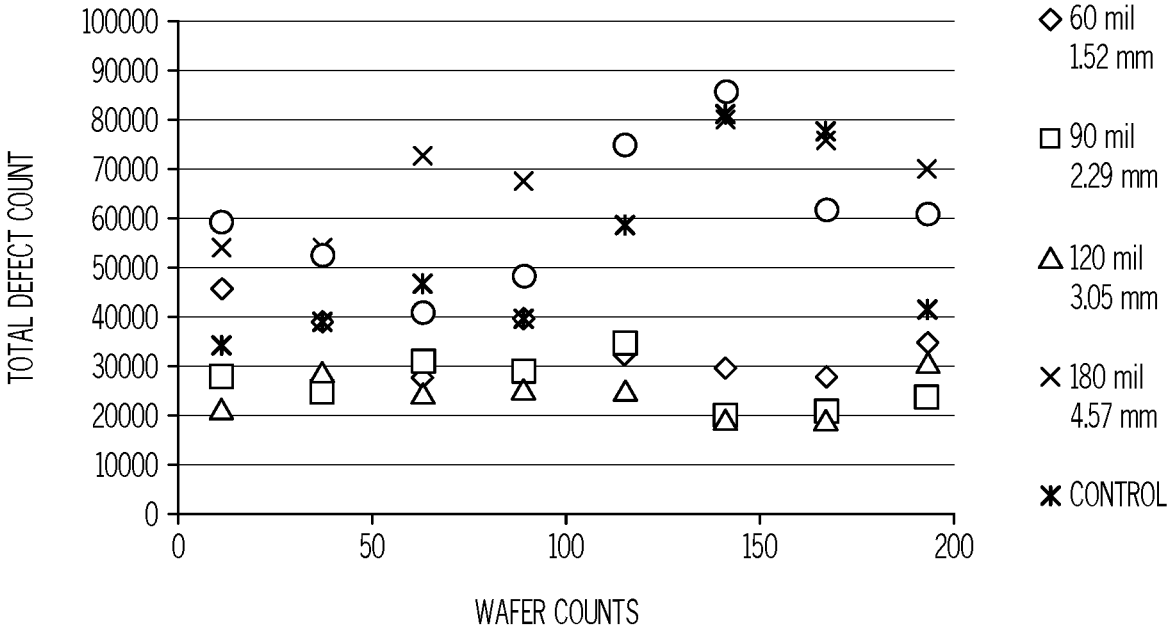
FIG. 13 is a plot of a post-HF etch defect summary that includes polishing pad groove patterns of the invention.

Defect data after HF etch was also examined to compare total defectivity to scratch density. HF etching is effective at removing particles, and increased the sensitivity to scratches, as the HF enlarges the scratch depth by removal of the strain region around the crack itself (decoration). As shown if FIG. 13, the same low and stable defect response was observed for the 90 mil (0.229 cm)/8 and the 120 mil (0.305 cm)/8 pads, although the 60 mil (0.152 cm)/8 pad response was more closely similar, indicating that a large fraction of the total defects in that pad sample were small particulates rather than large damaging aggregates. This is an indication that there is also a lower limit for the drainage efficiency ratio. Based on these results, the critical range for the radial drainage to feeder groove area ratio of 0.2 to 0.3 is most advantageous.

From the above discussion, it becomes clear that the drainage efficiency expression can be used to determine drainage groove dimensions and numbers needed for achieving reduced defectivity over a wide variety of feeder groove dimensions and pitches. Some practical limitations may be imposed; for example, it is probably undesirable to deploy only one drainage groove, due to rotational eccentricity. It is also concluded that the drainage grooves be restricted to radial grooves, or variations thereof. The reasons for this are as follows: a.) they possess a single rotational symmetry; and b.) they provide minimal contribution to texture-induced nanotopography (undesirable). As regards to groove dimensions, it may also be desirable to further regulate transport by designing the radial drainage grooves to widen with radius, with the limitations of the range of drainage efficiency ratios cited above, as calculated at the periphery of the pad.

The invention is efficacious for forming porous polishing pads for extended chemical mechanical planarization applications that maintain low defect levels. In addition, these pads can improve polishing rate, global uniformity and reduce polishing vibration.

We claim:

1. A polishing pad suitable for polishing or planarizing at least one of semiconductor, optical and magnetic substrates with a polishing fluid and relative motion between the polishing pad and the at least one of semiconductor, optical and magnetic substrates, the polishing pad comprising the following:

a polishing layer having a polymeric matrix and a thickness, the polishing layer including a center, a perimeter, a radius extending from the center to the perimeter and a polishing track that surrounds the center and intersects the radius, the polishing track representing a working region of the polishing layer for polishing or planarizing the at least one of semiconductor, optical and magnetic substrates;

a plurality of feeder grooves (δ) intersecting the radius, the feeder grooves (δ) having land areas between the feeder grooves (δ) for polishing or planarizing of the at least one of semiconductor, optical or magnetic substrates with the polishing pad and the polishing fluid, the plurality of feeder grooves (δ) having an average cross-sectional feeder area ($\delta_a$) calculated as width multiplied by depth, the average cross-sectional feeder area ($\delta_a$) being total cross-sectional area of each feeder groove divided by total number of feeder grooves (δ);

at least one radial drainage groove (ρ) in the polishing layer intersecting with the plurality of feeder grooves (δ) for allowing the polishing fluid to flow from the plurality of feeder grooves (δ) to the at least one radial drainage groove (ρ) and the at least one radial drainage groove (ρ) having an average drainage cross-sectional area ($\rho_a$) calculated as width multiplied by depth, the average drainage cross-sectional area of the at least one radial drainage groove ($\rho_a$) being greater than the average cross-sectional feeder($\delta_a$) area as follows:

$$2*\delta_a \leq \rho_a \leq 8*\delta_a$$

wherein ($n_r$) represents the number of radial drainage grooves and ($n_f$) represents the number of feeder grooves, the number of feeder grooves being a total summation from each side of the radial drainage grooves ($n_f$=2*feeder groove number) and $$(0.15)n_f*\delta_a \leq n_r*\rho_a \leq (0.35)n_f*\delta_a$$

wherein $n_r$ equals a number of 1 to 16 and the at least one radial drainage groove (ρ) extending through the polishing track for facilitating polishing debris removal through the polishing track and underneath the at least one of semiconductor, optical and magnetic substrates and then beyond the polishing track toward the perimeter of the polishing pad during rotation of the polishing pad.

2. The polishing pad of claim 1 wherein $2*\delta_a \leq \rho_a \leq 6*\delta_a$.

3. The polishing pad of claim 1 wherein the at least one radial drainage groove terminates into a circumferential perimeter groove and a perimeter land area surrounds the circumferential perimeter groove.

4. The polishing pad of claim 1 wherein the feeder grooves are concentric arcs.

5. The polishing pad of claim 1 wherein the at least one radial drainage groove has a depth greater than the feeder grooves.

6. A polishing pad suitable for polishing or planarizing at least one of semiconductor, optical and magnetic substrates with a polishing fluid and relative motion between the polishing pad and the at least one of semiconductor, optical and magnetic substrates, the polishing pad comprising the following:

a polishing layer having a polymeric matrix and a thickness, the polishing layer including a center, a perimeter, a radius extending from the center to the perimeter and a polishing track that surrounds the center and intersects the radius, the polishing track representing a working region of the polishing layer for polishing or planarizing the at least one of semiconductor, optical and magnetic substrates;

a plurality of feeder grooves (δ) intersecting the radius, the feeder grooves (δ) having land areas between the feeder grooves (δ) for polishing or planarizing of the at least one of semiconductor, optical or magnetic substrates with the polishing pad and the polishing fluid, the plurality of feeder grooves (δ) having an average cross-sectional feeder area ($\delta_a$) calculated as width multiplied by depth, the average cross-sectional feeder area ($\delta_a$) being total cross-sectional area of each feeder groove divided by total number of feeder grooves (δ);

radial drainage grooves (ρ) in the polishing layer intersecting with the plurality of feeder grooves (δ) for allowing the polishing fluid to flow from the plurality of feeder grooves (δ) to the radial drainage grooves (ρ) and the radial drainage grooves (ρ) having an average drainage cross-sectional area ($\rho_a$) calculated as width multiplied by depth, the average drainage cross-sectional area of the radial drainage grooves ($\rho_a$) being greater than the average cross-sectional feeder ($\delta_a$) area as follows:

$$2*\delta_a \leq \rho_a \leq 8*\delta_a$$

wherein ($n_r$) represents the number of radial drainage grooves and ($n_f$) represents the number of feeder grooves, the number of feeder grooves being a total summation from each side of the radial drainage grooves ($n_f$=2*feeder groove number) and $$(0.15)n_f*\delta_a \leq n_r*\rho_a \leq (0.35)n_f*\delta_a$$

wherein $n_r$ equals a number of 2 to 12 and the radial drainage grooves (ρ) extend through the polishing track for facilitating polishing debris removal through the polishing track and underneath the at least one of semiconductor, optical and magnetic substrates and then beyond the polishing track toward the perimeter of the polishing pad during rotation of the polishing pad.

7. The polishing pad of claim 6 wherein $2*\delta_a \leq \rho_a \leq 6*\delta_a$.

8. The polishing pad of claim 6 wherein the radial drainage grooves terminate into a circumferential perimeter groove and a perimeter land area surrounds the circumferential perimeter groove.

9. The polishing pad of claim 6 wherein the feeder grooves are concentric arcs.

10. The polishing pad of claim 6 wherein the radial drainage grooves have a depth greater than the feeder grooves.

* * * * *